United States Patent [19]

Yizhaki

[11] 3,946,601

[45] Mar. 30, 1976

[54] METHOD OF LOAD TESTING FOUNDATIONS

[75] Inventor: David Yizhaki, Haifa, Israel

[73] Assignee: Technion Research and Development Foundation, Ltd., Haifa, Israel

[22] Filed: June 26, 1974

[21] Appl. No.: 483,201

[30] Foreign Application Priority Data

July 20, 1973 Israel ..... 42798

[52] U.S. Cl. ..... 73/84

[51] Int. Cl.[2] ..... G01N 33/24

[58] Field of Search ..... 73/84, 88 E

[56] References Cited

UNITED STATES PATENTS

| | | | |
|---|---|---|---|
| 2,674,876 | 4/1954 | Caudill | 73/84 |
| 3,797,301 | 3/1974 | Hawes | 73/88 E X |

FOREIGN PATENTS OR APPLICATIONS

| | | | |
|---|---|---|---|
| 1,077,660 | 5/1954 | France | 73/84 |
| 575,050 | 4/1933 | Germany | 73/84 |

*Primary Examiner*—Charles A. Ruehl

*Attorney, Agent, or Firm*—Michael P. Breston

[57] ABSTRACT

The invention relates to a method of, and a rig for, testing vertical foundation piles and foundations to determine the ultimate bearing capacity of the pile and the settlement behavior of the foundation soil.

4 Claims, 3 Drawing Figures

FIG. 1.
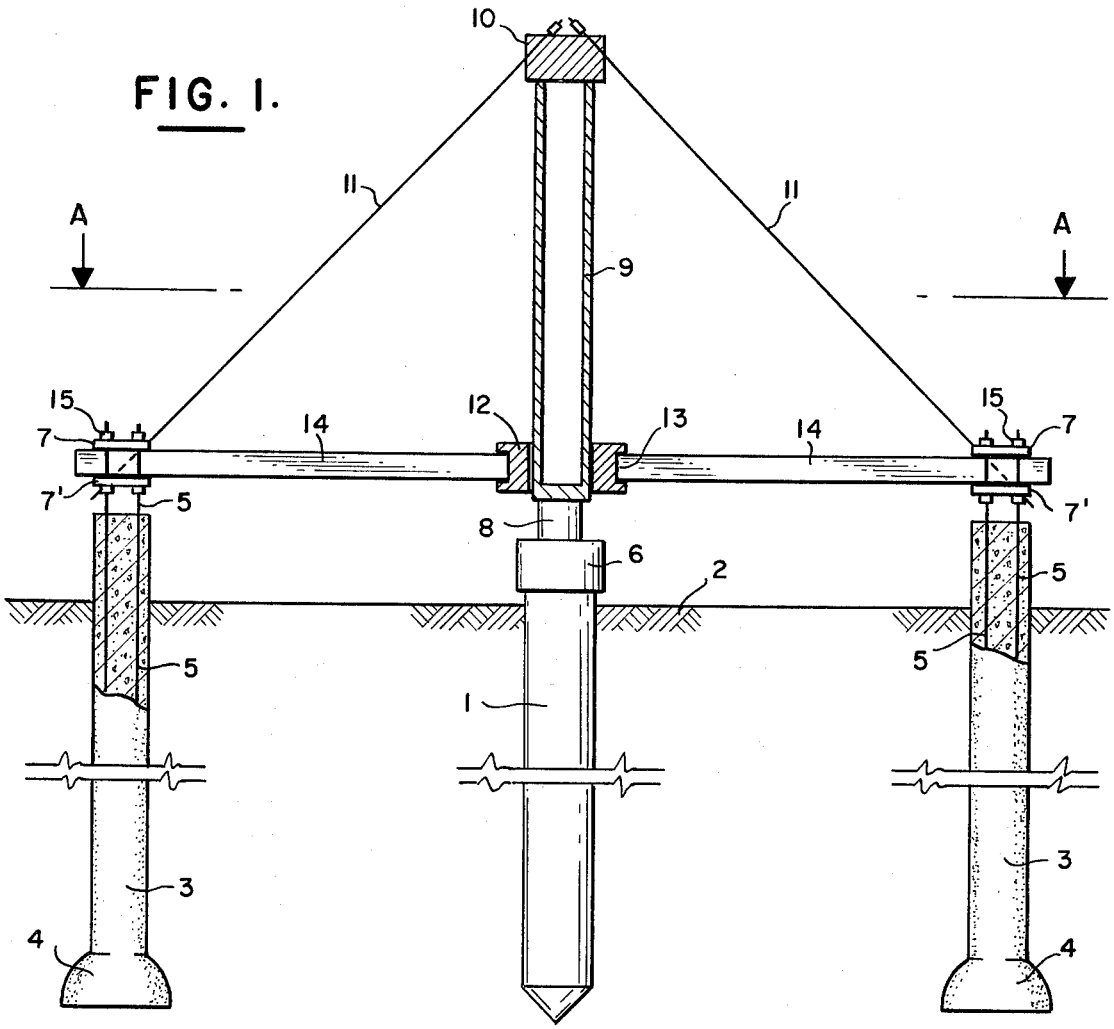
FIG. 2.
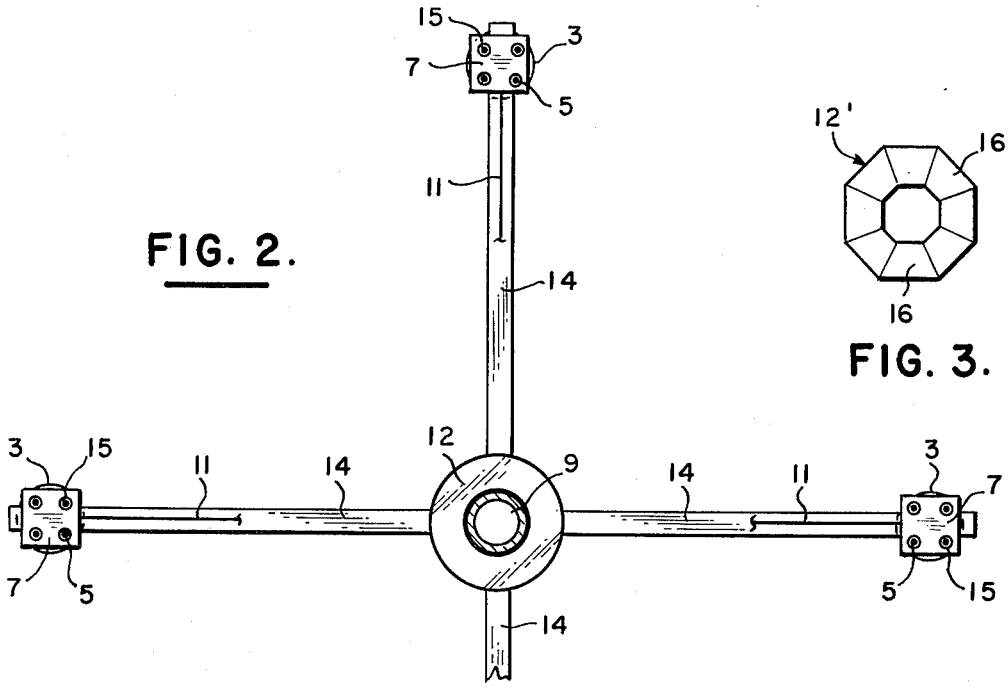
FIG. 3.

METHOD OF LOAD TESTING FOUNDATIONS

BACKGROUND OF THE INVENTION

The methods for load testing in present use comprise either loading the head of the pile with an appropriate weight or applying a downward force thereon by means of hydraulic jacks acting against a ballast or against a reaction member held down by anchors sunk into the soil at a distance from the pile or foundation to be tested.

An apparatus in use with the first method consists of a box or platform which is supported on top of the pile to be tested and is loaded with earth, sand, pig iron or the like up to the desired test load. This method, however, is very crude and does not lend itself to exact measurements. It has been improved by a similar arrangement, wherein a box or platform is placed with its center above the test pile, while both of its ends are supported on cribbing or the like. A calibrated jack is placed on top of the pile and, while actuated, presses against the bottom of the box or platform which is duly reinforced by beams or girders. The latter is either lifted off the cribbing if the test load equals the load put onto it, or its ends remain on their supports if it is intentionally loaded by a greater weight than the test load to be applied, the latter method being preferred in most cases. This method enables exact measurement and lends itself to fully loading the pile within a relatively short time period.

Both methods, however, suffer from the drawback that the soil is preloaded and compacted in the areas supporting the platform or box prior to and during the test, which falsifies the test results, giving in fact higher values of soil resistance and bearing capacity.

Some of the above drawbacks are obviated by a device in use with the second method, wherein two or more piles to be used as anchors are driven into the soil as far from the test pile as possible. A girder or beam of sufficient strength and resistance against bending is attached to the upper ends of the anchors with its center passing above the test pile, and a calibrated hydraulic jack is positioned between the top of the test pile and the underside of the girder or beam. For applying the desired load onto the test pile the jack is actuated against the beam which transfers the force to the anchors, thus pressing the test pile into the soil.

This method requires a very heavy beam or girder whenever the anchors are positioned sufficiently far from the test pile so as not to influence the distribution of forces and stresses in the soil. Consequently a heavy crane is required adding to the expenses of the loading test. With a view of reducing these expenses, soil anchors are often sunk at a shorter distance from the test pile, which allows for a lighter beam or girder, but may give completely erroneous results, owing to the upwardly directed forces acting on the anchors which are transferred to the test pile by the surrounding soil.

A further shortcoming of the methods and apparatus enumerated above is that for measuring the consolidation settlement behavior over a larger time period the loading force requires regular and frequent adjustment by means of the jack or jacks, since the beams or girders used with these apparatus are stiff and rigid, so that the load is soon reduced when the test pile settles.

The main objects of the present invention are to overcome the above-mentioned shortcomings and to provide a test-loading rig that (1) allows the positioning of the anchors at a sufficiently large distance from the test pile, (2) is of light weight lending itself to easy handling and erection, and (3) enables the measuring of consolidation settlement over a long period of time without the necessity of frequently adjusting the load on the test pile by operating a jack or jacks.

SUMMARY OF THE INVENTION

In the method of this invention, at least three anchor piles or soil anchors are sunk into the soil at a relatively great and equal distance from the pile to be tested. The rig used in this method comprises (a) a vertical center post built to withstand the test load without buckling, (b) a preferably calibrated jack or other lifting device placed between the top of the test pile and the bottom of the center post, (c) an annular reaction block slidingly and co-centrally arranged on the center post adjacent to its lower end, (d) at least three substantially horizontal compression members each engaging at its inner end with one fastening means in the annular reaction block, and with its outer end engaging with the upper portion of one of the anchor piles, provision being made for the attachment of a tension member in proximity of its outer end, (e) at least three diagonally placed tension members of a high tensile strength such as cables or steel bars, each attached at its upper inner end to a point near the upper end of the center post and at its lower outer end to one of the horizontal compression members, these tension members being so dimensioned as to be considerably elongated within the elastic limit of the material by the resultant axial forces.

BRIEF DESCRIPTION OF THE DRAWINGS

FIG. 1 is a cross section through a load testing rig;
FIG. 2 is a section along A—A of FIG. 1; and
FIG. 3 shows a modification of the reaction block.

With reference to the drawing, a test pile 1 is shown with its upper end projecting out of the soil 2. Four concrete anchors 3 (three of which are visible in FIG. 2) are placed in square arrangement with the test pile in the center of this square. The anchors are of the type having a mushroom base 4 which serves to withstand forces in upward direction; each anchor is provided with four vertical anchor bolts 5 embedded in the concrete and projecting out of the upper horizontal face.

The test loading rig comprises a hydraulic jack 6, which is concentrically placed on the flat top of the test pile, with its piston 8 pointing in an upward direction. On top of piston 8 and concentrically therewith is positioned a strong vertical center post in the shape of a thick-walled steel tube 9 with its axis substantially vertical. Tube 9 carries on its top portion a concentric cylindrical block 10 for the attachment of four tension members 11. An annular reaction block 12 is slidingly positioned on the center post 9 in the lower portion thereof; its inner bore is somewhat larger than the outer diameter of the center post and its outer circumference is recessed in four equidistant places to form four cavities 13. From block 12 four horizontal compression members 14 extend radially to the four anchor piles to which they are rigidly fastened by means of the anchor bolts 5 and upper and lower anchor plate 7, 7'. Each connection is made with the aid of suitable nuts and bolts 15. The inner end of the compression members conform in shape to the cavities 13 in the reaction block 12 and are inserted into these. The compression members consist of steel or concrete beams designed to take up the horizontal load without buckling. The beams possess near their outer ends means, such as perforations, for connecting the lower ends of the tension members 11. The members 11 consist either of steel cables or of high tensile steel bars having at their ends means for connecting them to the cylindrical block 10 and the tension members 11 respectively.

For load testing, the rig is brought to the site in disassembled state, which enables its setting up by means of a light lifting device. As soon as the rig is completely assembled, jack 6 is actuated thereby lifting the center post 9 and tensioning the tension members 11 against the horizontal compression members 14 and the anchor piles 3. Jack 6 is generally calibrated so that the load exerted by it can be calculated by measuring the soil pressure in the cylinder. After the full load has been applied the settling of the test pile is measured by any method known to the art, and similarly the consolidation settlement is measaured, with the jack maintained in its extended position. Owing to the high tensile strength and small cross section of the tension members these are considerably elongated by the forces resulting from the operation of the hydraulic jack. Accordingly, the load on the test pile decreases very slowly during its gradual settling, as this does not considerably affect the length of the tension members and actuation of the jack is required at infrequent intervals only.

FIG. 3 shows an octagonal reaction block 12' which is suitable for the connection of eight compression members to be tied to eight anchors which may be required in cases of great test loads. As can be seen the block is manufactured from eight steel segments 16 and, accordingly, the inner opening is also octagonal, of such size that its fits slidingly over the diameter of the center post.

Instead of inserting the compression members into the cavities 13, the fixation of these to the reaction member can be made by any other suitable means. The compression members may be held in horizontal position by bars or cables anchored in the ground so as to prevent dislocation of the reaction member.

On the other hand the movement of the reaction member on the center post may be limited by collars fixed to the latter at a short distance from its upper and lower surfaces, respectively.

The center post which has to sustain compression forces only, could be made in the shape of a concrete column, however this may demand heavier lifting equipment due to its greater weight.

What is claimed is:

1. A test rig for load testing of a pile, said rig being adapted for use in conjunction with at least three anchor piles equidistantly spaced from the tested pile, comprising:

a. a vertical center post, b. a lifting device placed between the top of the test pile and the bottom of the center post, c. an annular reaction block slidingly and co-centrally arranged on the center post, d. at least three horizontal, radially-extending compression members, said block being provided on its outer circumference with coupling means for coupling said block to said compression members, each compression member engaging its inner end with one coupling means in said block, and its outer end with the upper portion of one of said anchor piles, e. at least three tension members each being attached at its upper inner end to a point in the upper portion of the center post and at its outer lower end to a point near the outer end of a corresponding horizontal compression member, and said tension members being dimensioned to become considerably elongated within the elastic limit of their material by the axial forces resulting from said load testing.

2. A test rig as claimed in claim 1 wherein the center post consists of a steel tube provided at its upper end with a cylindrical block for the attachment of said tension members.

3. A test rig as claimed in claim 1 wherein the tension members consist of high tensile cables.

4. A test rig as claimed in claim 1 wherein the tension members consist of cylindrical bars.

* * * * *